US006494692B1

(12) United States Patent
Green

(10) Patent No.: US 6,494,692 B1
(45) Date of Patent: Dec. 17, 2002

(54) PERISTALTIC PUMPS

(75) Inventor: Andrew Green, Falmouth (GB)

(73) Assignee: Watson-Marlow Limited, Cornwall (GB)

( * ) Notice: Subject to any disclaimer, the term of this patent is extended or adjusted under 35 U.S.C. 154(b) by 0 days.

(21) Appl. No.: 09/561,370

(22) Filed: Apr. 28, 2000

(30) Foreign Application Priority Data

Apr. 29, 1999 (GB) ..... 9909913

(51) Int. Cl.[7] ..... F04B 43/12
(52) U.S. Cl. ..... 417/477.1
(58) Field of Search ..... 417/474, 476, 417/477.1, 477.3, 477.7, 477.13; 285/247, 256

(56) References Cited

U.S. PATENT DOCUMENTS

| | | | | | |
|---|---|---|---|---|---|
| 3,756,752 A | * | 9/1973 | Stenner | 417/477.1 |
| 3,788,676 A | * | 1/1974 | Lossie | 285/247 |
| 4,184,815 A | | 1/1980 | Casson et al. | |
| 4,496,295 A | | 1/1985 | King | |
| 4,498,691 A | * | 2/1985 | Cooke | 285/256 |
| 4,544,187 A | * | 10/1985 | Smith | 285/256 |
| 4,661,045 A | * | 4/1987 | Winston et al. | 417/477.1 |
| 4,798,590 A | * | 1/1989 | O'Leary et al. | 417/477.1 |
| 4,976,590 A | | 12/1990 | Baldwin | |
| 5,213,483 A | | 5/1993 | Flaherty et al. | |
| 5,356,267 A | * | 10/1994 | Fulmer et al. | 417/477.1 |
| 5,388,972 A | | 2/1995 | Calhoun et al. | |

FOREIGN PATENT DOCUMENTS

| | | |
|---|---|---|
| FR | 2071238 | 9/1971 |
| GB | 2145776 A | 7/1984 |
| WO | WO/88/05868 | 8/1988 |

* cited by examiner

*Primary Examiner*—Michael Koczo
(74) *Attorney, Agent, or Firm*—Duane Morris LLP

(57) ABSTRACT

A peristaltic pump comprises a housing (2) in which a peristaltic action is applied to a tube (6) by a rotor (4). The tube (6) has locating means in the form of flanges (16) at each end, which ensure proper positioning of the tube (6) within the housing (2). The housing (2) makes a fluid-tight seal with the flanges (16) so that the interior of the housing (2) is isolated from the ambient surroundings. The flanges (16) are non-circular and fit in complementary recesses (30), (32) in the housing (2) so that, when installed, the tube (6) is not twisted between its ends.

15 Claims, 2 Drawing Sheets

FIG. 1
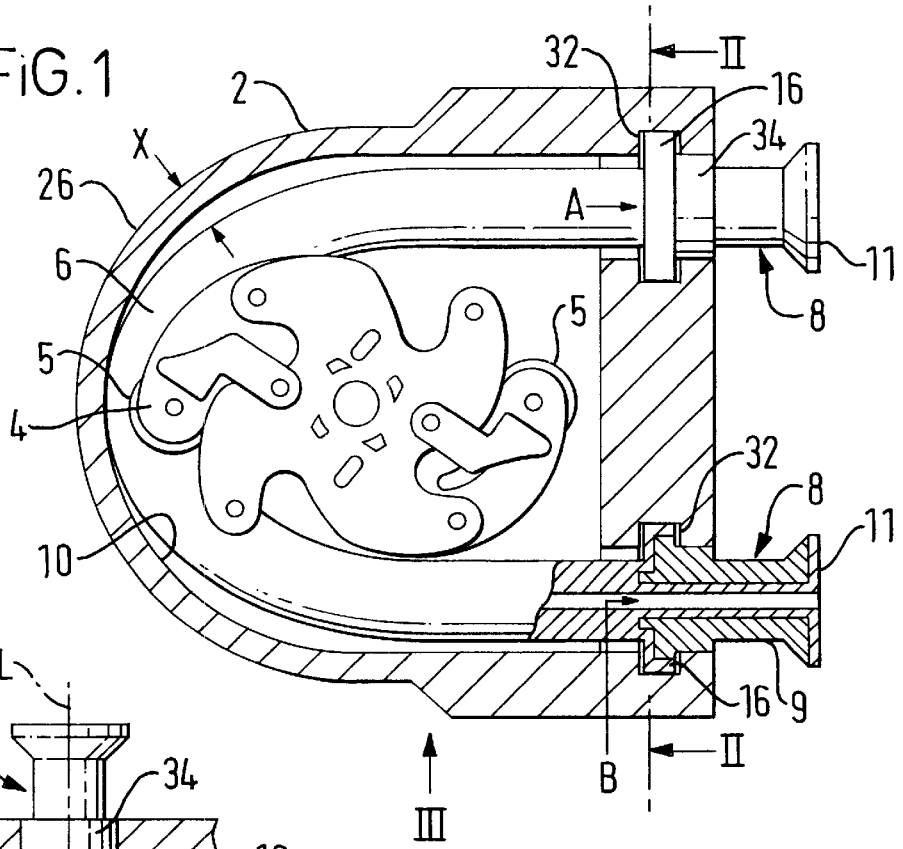
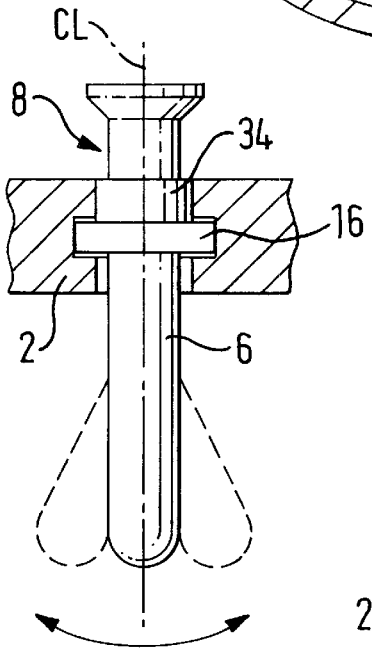
FIG. 3
FIG. 2
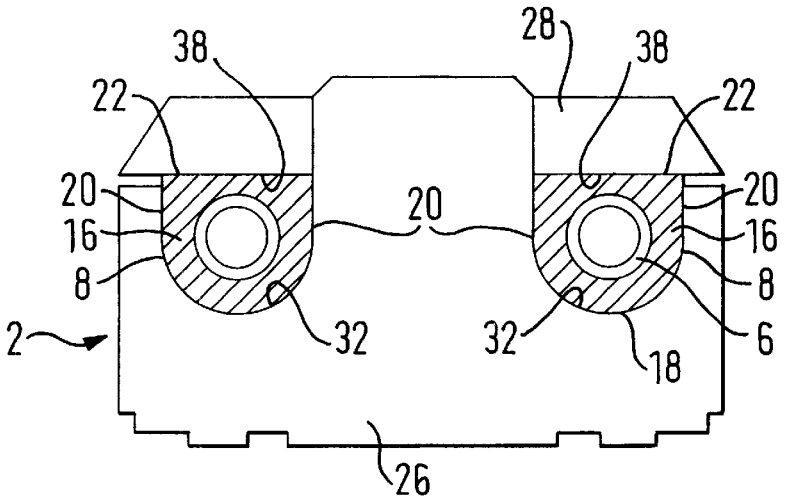

PERISTALTIC PUMPS

FIELD OF INVENTION

This invention relates to peristaltic pumps.

BACKGROUND OF THE INVENTION AND PRIOR ART

Conventional peristaltic pumps comprise a pumphead housing in which a tube extends. The tube is acted upon by drive means such as a rotor to perform a peristaltic pumping action. The tube extends from the pumphead housing and is provided at its ends with connectors for connection to other equipment.

With such pumps, the tube is gripped by the is housing to ensure that it is held stationary with respect to the housing so that the rotor can act properly upon it. However, when fitting the tube, it is not always easy to ensure that the tension of the tube around the rotor is correct nor that the tube is not twisted or otherwise distorted. Improper installation of the tube can lead to poor pump performance and short tube life, particularly if the pump is operated at high pressure.

SUMMARY OF THE INVENTION

In accordance with the present invention there is provided a peristaltic pumphead comprising a pumphead housing accommodating a tube and driving means for causing a peristaltic action in the tube, the tube being provided at each end with locating means for locating the ends of the tube releasably in the pumphead housing to prevent lengthwise displacement of each end of the tube relative to the pumphead housing.

Since the tube ends are precisely located within the pumphead housing, it is possible for the tube, with the locating means, to be supplied in required lengths so that the tension in the tube, after fitting, is correct. The locating means may be provided with fittings to enable the connection of further equipment.

The locating means may take the form of cooperating flanges and recesses provided one on the pumphead and one on the tube. For example, the locating means on the tube may comprise a flange projecting outwardly from the wall of the tube, while the pumphead may have a recess for receiving the flange at each end of the tube. The flange may be non-circular; for example, it may have a flat for engaging a complementary part of the recess. This measure ensures that each end of the tube is installed in a predetermined orientation, so avoiding twisting of the tube on installation. Also, the use of locating means in accordance with the present invention can avoid the need to clamp the tube in order to maintain it in position. Such clamping tends to throttle the flow through the tube, particularly if high pressures are to be maintained.

The locating means may be a close fit with the corresponding formation in the pumphead housing. The pumphead housing may be in two parts, which are brought together to form a sealed enclosure and to clamp the locating means between them in a fluid-tight manner.

The locating means may be provided on an end fitting attached to the tube end, or it may be formed integrally, for example by moulding, on the tube end region. If the locating means is a separate fitting, it may be fitted to the tube end by means of a simple push-fit, or it may be secured to the tube end by swaging.

In most conventional peristaltic pumps, the tube is arranged in a semi-circular arc around a rotor which forms the driving means. The wall of the pumphead housing defines a track within which the tube lies. In a preferred embodiment, the tube has an overall length which is slightly shorter than the combined length of the track and the distances between the ends of the track and the ends of the tube, A consequence of this is that, when installed, the tube is spaced slightly from the track. As a result, the tube is centred more reliably within the track during operation.

A pump in accordance with the present invention may be capable of maintaining relatively high output pressures, for example up to 4 bar.

BRIEF DESCRIPTION OF THE DRAWINGS

FIG. 1 is a sectional view of a peristaltic pump;

FIG. 2 is a sectional view take on the line II—II in FIG. 1;

FIG. 3 is a partial view of a tube of the pump of FIGS. 1 and 2, taken in the direction of the arrow III in FIG. 1;

DETAILED DESCRIPTION OF PREFERRED EMBODIMENTS

Figure 4:
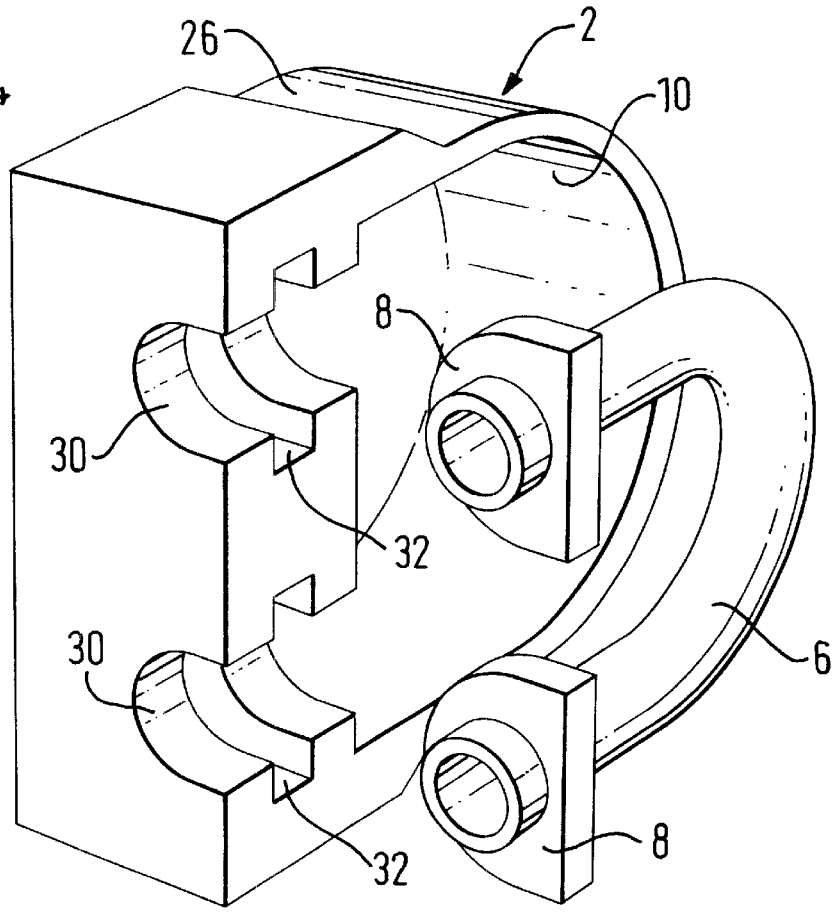
FIG. 4 is an exploded view of the tube and housing part of the pump of FIGS. 1 and 2.

The peristaltic pump shown in FIG. 1 comprises a housing 2 within which driving means in the form of a rotor 4 having rollers 5 is mounted for rotation by a motor (not shown) situated outside the housing 2. A tube element is also mounted in the housing and comprises a tube 6 having end fittings 8. The tube 6 extends around the rotor 4 and lies within a track 10 formed within the housing 2.

Each end fitting 8 is made from a relatively rigid plastics material to provide secure clamping and location of the end fitting 8 within the housing 2 and against further equipment. The end fitting 8 is either fabricated onto the tube 6 or moulded within the tube 6. The more flexible material of the main portion of the tube 6 extends through the hollow interior of each element 9 and over the end of the face of the elements 9 to provide a sealing surface 11.

The end fitting has a flange 16 which, as shown in FIG. 2, has a non-circular (substantially D-shaped) periphery. This periphery has a semi-circular portion 18 from the ends of which two parallel straight edge portions 20 extend. A flat 22 extends between the straight edge portions 20.

The housing 2 is made up of a body 26 and a lid 28 (FIG. 2). The body 26 has two U-shaped recesses 30 in each of which a groove 32 is formed. The groove 32 receives the flange 16 of the respective fitting 8 while the portions of the recess 30 on each side of the groove 32 receive, respectively, the end of the main portion of the tube 6 and a boss 34 situated next to the flange 16 on the side towards the sealing surface 11.

The cover 28 has a flat surface 38 which engages the flats 22 on the fittings 8 to clamp the fittings 8 firmly into the recess 30 to provide a fluid-tight seal. The material of the main portion of the tube 6 extends over the flanges 16 to improve sealing. The body 26 and cover 28 are themselves connected together to provide an enclosure which may be fluid-tight.

The tube element comprising the tube 6 and the fittings 8 is supplied as an integral element with the tube length (between the faces A and B shown in FIG. 1) established to close tolerances. This length is slightly shorter than the combined length of the track 10 and the portions of the housing 2 between the ends of the track 10 and the flanges 16. The result of this is that, when installed, the tube 6 is tensioned properly over the rotor 4, as shown in FIG. 1. The rollers 5 compress the tube 6 against the track 10 while on each side of the active roller 5 the tube 6 lifts from the track 10, as indicated in FIG. 1 at X.

It will be appreciated that the cooperation between the flanges 16 and the recesses 30 and grooves 32 establish accurately the position of each end of the tube 6 with respect to the housing 2, and in particular with respect to the rotor 4 and the track 10. The resulting correct tensioning of the tube 6 over the active roller 5 has the result that the tube 6 is naturally drawn to the centreline CL of the rollers 5 as shown in FIG. 3. This avoids lateral deflection of the tube 6 to positions shown in broken outline in FIG. 3. Furthermore, the non-circular profile of the flanges 16 and the grooves 32 in which they sit ensures that there is no twist in the tube 6 when installed. Also, the fact that the two parts 26 and 28 of the housing 2 engage the relatively rigid flanges 16, rather than the flexible tube 6 itself, means that reliable sealing can be achieved between the housing 2 and the tube 6. A major consequence of these features is that initial installation and subsequent replacement of the tube 6 can be carried out with a high degree of reliability, ensuring both accurate positioning of the tube 5 in relation to the rotor 4 and the track 10, and proper sealing between the flanges 16 and the housing 2, In particular, the length of the tube 6 is predetermined, and is not dependent on the skill of the operator during installation of the tube 6. Furthermore, the tube 6 cannot be installed in a twisted manner, nor can its ends be misaligned.

The sealing of the pumphead housing 2 means that the pumped fluid can be contained should the tube 6 burst, which is a particularly important feature if the pump is capable of operating at high pressure or is handling toxic or corrosive fluids.

Figure 5:
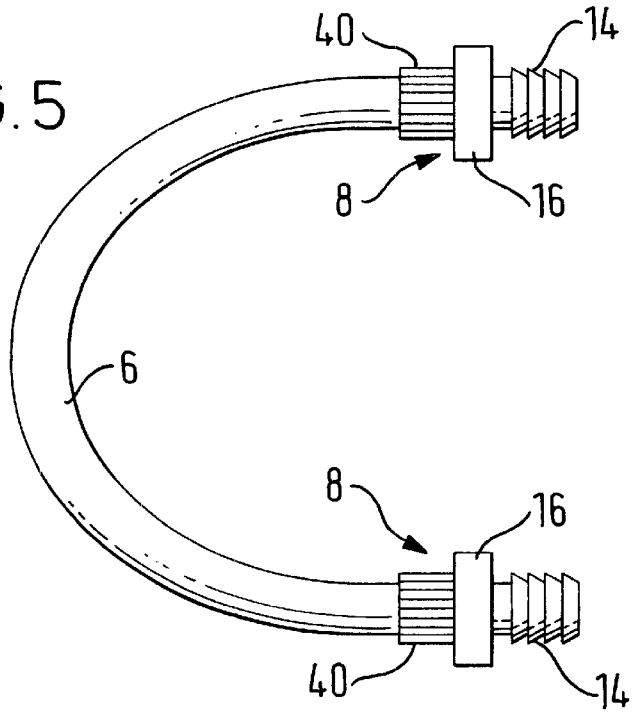
FIG. 5 shows an alternative configurations for the tube.

FIG. 5 shows an alternative configuration for the ends of the tube 6. The fitting 8 shown at A comprises a fabricated collar 40 surrounding the tube end and a spigot 14 for attachment of a further tube.

The termination of the tube 6 at the end fittings 8 and 9 has the effect of isolating the tube from the further tubing connected to it, and the fluid contained therein. Consequently, the transmission of vibration from the pump (for example as a result of the pressure pulses caused by the passage of the rollers 5) to the downstream fluid can be minimised. The reduction of vibration transmission can be enhanced by increasing the size and therefore rigidity of the flanges 16.

I claim:

1. A peristaltic pumphead comprising;

a pumphead housing;

a tube accommodated in the pumphead housing, the tube having opposite ends; and driving means adapted to cause a peristaltic action in the tube, the tube being provided at each end with a respective end fitting which is fixedly permanently secured to the tube by a collar swaged onto each end of said tube and is adapted for connection to further equipment, wherein each end fitting has a non-circular locating flange received in a complementary recess in the pumphead housing in a manner which secures the ends of the tube releasably in the pumphead housing against lengthwise displacement and rotation of each, of the tube ends relative to the pumphead housing thereby to prevent lengthwise displacement and rotation of each end of the tube relative to the pumphead housing.

2. A peristaltic pumphead as claimed in claim 1, in which the locating means at each tube comprises a flange on the end fitting which cooperates with a complementary recess in the pumphead housing.

3. A peristaltic pumphead as claimed in claim 2, in which the flange and the complementary recess are non-circular.

4. A peristaltic pumphead as claimed in claim 3, in which the periphery of the flange and of the complementary recess include a flat portion.

5. A peristaltic pumphead as claimed in claim 2, in which the flange is a fluid-tight fit in the recess.

6. A peristaltic pumphead as claimed in claim 1, in which the pumphead housing comprises two parts which are secured together, thereby to clamp the locating means between them.

7. A peristaltic pumphead as claimed in claim 1, in which the driving means comprises a rotor, and in which the housing has an arcuate track extending partially around the rotor and receiving the tube, the length of the tube being shorter than the combined length of the track and the distances from the ends of track to each tube end, whereby a clearance is provided between the track and the tube.

8. A peristaltic pumphead comprising:

a pumphead housing having an arcuate track;

a tube accommodated in the arcuate track, the tube having opposite ends; and a driving rotor situated within the pumphead housing and engaging the tube to periodically compress the tube against the arcuate track to cause a peristaltic action in the tube, the tube being provided at each end with a respective end fitting which is fixedly secured to the tube by a collar that is swaged onto each end of the tube and is adapted for connection to further equipment, wherein each end fitting has a non-circular locating flange received in a complementary recess in the pumphead housing thereby to locate the ends of the tube releasably in the pumphead housing against lengthwise displacement and rotation of each end of the tube relative to the pumphead housing.

9. A peristaltic pumphead according to claim 8, in which the driving means comprises a rotor, and which the housing has an arcuate track extending partially around the rotor and receiving the tube.

10. A peristaltic pumphead as claimed in claim 9, in which the periphery of the flange and of the complementary recess include a flat portion.

11. A peristaltic pumphead as claimed in claim 8, in which each end fitting comprises a rigid element fixedly positioned within a tube end.

12. A peristaltic pumphead as claimed in claim 8, in which the length of the tube is shorter than the combined length of the track and the distances from the ends of track to each tube end, whereby a clearance is provided between the track and the tube.

13. A peristaltic pumphead including a peristaltic pumphead comprising;

a pumphead housing having an arcuate track;

a tube accommodated in the arcuate track, the tube having opposite ends each of said ends being surrounded by a collar that is swaged onto each end of the tube; and a driving rotor situated within the pumphead housing and engaging the tube to periodically compress the tube against the arcuate track to cause a peristaltic action in the tube, the tube being provided at each end with a respective end fitting which is fixedly secured to the tube by said swaged collar and is adapted for connection to further equipment, wherein each end fitting has a non-circular and nonrectilinear locating flange having a flat peripheral portion, a semicircular portion the ends of which are connected to the flat peripheral portion by two parallel straight edge portions, and wherein the pumphead housing has recesses receiving the respective flanges, the recesses having a shape which is complementary to the shape of the respective flange, thereby to locate the ends of the tube releasably in the pumphead housing against lengthwise displacement and rotation of each end of the tube relative to the pumphead housing.

14. A peristaltic pumphead comprising;

a pumphead housing;

a tube accommodated in the pumphead housing, the tube having opposite ends; and driving means adapted to cause a peristaltic action in the tube, the tube being provided at each end with a respective end fitting which comprises a rigid element fixedly secured at said tube end and adapted for connection to further equipment, wherein each end fitting has a locating flange received in a complementary recess in the pumphead housing in a manner which secures the ends of the tube releasably in the pumphead housing against lengthwise displacement and rotation of each of the tube ends relative to the pumphead housing, the material of the tube being disposed in surrounding integral relation to the rigid element, and extending over a radially extending surface and a peripheral axially extending surface of the locating flange.

15. A peristaltic pumphead as claimed in claim 14, in which the material of the tube extending over said surfaces of the locating flange provides sealing means between each locating flange and the respective recess.

* * * * *